US007891054B2

(12) United States Patent
Nicolas Domingo

(10) Patent No.: US 7,891,054 B2
(45) Date of Patent: Feb. 22, 2011

(54) HINGE FOR AUTOMOTIVE VEHICLE DOORS

(75) Inventor: Joaquin Nicolas Domingo, Montgat (ES)

(73) Assignee: Flexngate Automotive Iberica, S.A., Les Franqueses Del Valles (ES)

( * ) Notice: Subject to any disclaimer, the term of this patent is extended or adjusted under 35 U.S.C. 154(b) by 0 days.

(21) Appl. No.: 12/621,075

(22) Filed: Nov. 18, 2009

(65) Prior Publication Data

US 2010/0064479 A1 Mar. 18, 2010

Related U.S. Application Data

(63) Continuation of application No. PCT/EP2008/056135, filed on May 19, 2008.

(30) Foreign Application Priority Data

May 31, 2007 (ES) ..... 200701559

(51) Int. Cl.
*E05D 11/10* (2006.01)

(52) U.S. Cl. ..... 16/334; 16/303; 16/50; 296/146.11

(58) Field of Classification Search ..... 16/334, 16/303, 330–332, 348, 300, 341, 342, 50, 16/85, 312–315; 296/146.11
See application file for complete search history.

(56) References Cited

U.S. PATENT DOCUMENTS

| | | | | |
|---|---|---|---|---|
| 5,918,347 | A * | 7/1999 | Morawetz | 16/322 |
| 6,481,056 | B1 * | 11/2002 | Jesse | 16/334 |
| 6,739,020 | B1 | 5/2004 | Morawetz | |
| 7,076,836 | B1 * | 7/2006 | Butka | 16/342 |
| 7,096,536 | B2 * | 8/2006 | Johnson | 16/300 |
| 7,461,432 | B2 * | 12/2008 | Lowen et al. | 16/334 |
| 7,716,787 | B2 * | 5/2010 | Duning et al. | 16/330 |

FOREIGN PATENT DOCUMENTS

| | | | |
|---|---|---|---|
| DE | 4406824 | A1 | 9/1995 |
| DE | 102005001706 | A1 | 7/2006 |
| EP | 1056916 | B1 | 4/2003 |
| WO | 03104593 | A1 | 12/2003 |

OTHER PUBLICATIONS

PCT International Search Report and Written Opinion in counterpart International Application No. PCT/EP2008/056135, dated Sep. 24, 2008.

* cited by examiner

*Primary Examiner*—William L. Miller
(74) *Attorney, Agent, or Firm*—Edell, Shapiro & Finnan, LLC

(57) ABSTRACT

A hinge for vehicle doors includes: a first part fixable to a vehicle door and including an essentially vertical pin; a second part fixable to a frame of the vehicle and including an essentially cylindrical and vertical first cavity that houses the vertical pin; and a retaining device that retains infinite angular positions between the first and second parts. The retaining device includes: a sleeve surrounding the pin in the first cavity and an engagement member arranged between the pin and the sleeve. The engagement member couples the sleeve to the pin in any angular rest position of the hinge and automatically decouples the sleeve from the pin during relative rotation between the first and second parts. An interruption of the relative rotation between the first and second parts causes the engagement member to automatically couple the sleeve to the pin.

6 Claims, 3 Drawing Sheets

HINGE FOR AUTOMOTIVE VEHICLE DOORS

CROSS REFERENCE TO RELATED APPLICATIONS

This application is a continuation of International Application No. PCT/EP2008/056135, filed on May 19, 2008, entitled "Hinge for Automotive Vehicle Doors," which claims priority under 35 U.S.C. §119 to Application No. ES P200701559 filed on May 31, 2007, entitled "Hinge for Automotive Vehicle Doors," the entire contents of which are hereby incorporated by reference.

FIELD OF THE INVENTION

The invention relates to a hinge for automotive vehicle doors of the type comprising two parts hingedly connected to one another, which is provided with a retention device for retaining infinite angular positions between the first and second parts.

BACKGROUND

Door hinges for vehicles incorporating retention devices are currently known, which retention devices allow the vehicle door to be stably released in one or several preset open positions, preventing the door form being prematurely and automatically closed in an unwanted manner.

By way of example, patent document EP1056916 describes a hinge incorporating a check mechanism for the purpose of providing controlled angular positions in which the hinge leaves forming the actual hinge are maintained such that the door can be released in the desired angular positions. To that end, a check body is provided having a plurality of check members which are pushed radially outwards to make contact with a surrounding check reaction member. The check body is preferably integral with a hinge leaf whereas the check reaction member is integral with the other hinge leaf, such that the rotation of the hinge leaves in relation to one another makes the check body rotate in relation to the check reaction member. The check members are ball-shaped, and the check reaction member has an inner annular face provided with a series of recesses in correspondence with the number of balls of the check body.

Patent document DE 19953077 describes a mechanical alternative for providing a hinge with multiple locking positions according to respective angular positions adopted by the hinge leaves in relation to one another. To that end, the check body is forced by elastic means to remain supported against the rotating surface of the pin of the hinge, which is integral with the mobile hinge leaf, the circumferential contour of which is suitably profiled or even beveled in order to achieve a continuous check effect between the hinge leaves when the pin of the hinge rotates about the hinge axis, and a locking in the angular positions in which the check body can be stably supported against the contour of the pin of the hinge.

Although the described embodiments allow the locking of the door in different angular positions, said locking positions are preset, therefore the door is not locked in any angular position chosen by a user. These designs lack a hinge incorporating a check device suitable for achieving a locking effect, or a retention effect, without the jerking of the door, such that from any one position of the door, the user, after overcoming an initial predetermined force for commencing the rotational movement of the door in either direction, can move the door to another position of interest and release it, the door being automatically retained again, maintaining the position in which it has been released.

Patent document DE 4406824 describes a door hinge for a motor vehicle with an integrated check and locking function which, in order to achieve a continuous check and a locking without the jerking of the vehicle door, proposes fixing the pin of the hinge in an anti-rotational manner in the support eye of a first hinge half and providing it with at least one radially upward wedge-shaped surface in its entire length in which it must be supported for its movement, and arranging opposite to this wedge surface at least one radially upward wedge surface in the inner perimeter of the borehole of the respective support eye of the second hinge half.

One of the drawbacks of this embodiment is that the opening movement of the door is continuously checked, this check furthermore increasing as the opening angle of the door increases.

SUMMARY

The hinge object of the invention is particularly, but not exclusively, suitable for automotive vehicle doors. The hinge in question is formed by two complementary parts joined to one another through an essentially vertical pin integral with the first of said parts, the latter being intended to be solidly fixed to a vehicle door, while the second part is intended to be solidly fixed to the frame of the vehicle.

The hinge is essentially characterized in that it is provided with a retaining device for retaining infinite angular positions between the first and second parts, comprising an essentially cylindrical and vertical first cavity, integral with the second part, in which all or part of the pin and an enveloping sleeve are housed, engagement means being arranged between the pin and the sleeve, which means keep them connected to one another in any angular rest position of the hinge and are suitable for automatically disconnecting them while a relative rotation between both parts of the hinge and therefore an opening or closing movement of the vehicle door occurs, and for also automatically connecting them when said relative rotation between both parts of the hinge is interrupted, direct actuation means of the engagement means being arranged at one of the ends of the enveloping sleeve.

According to another feature of the invention, the mentioned engagement means comprise at least one peripheral member contiguous to the pin which is longitudinally movable in relation to the latter between an engaged position and another disengaged position, through at least one corresponding groove made on the inner face of the enveloping sleeve, and subjected to the action of first elastic means tending to keep it in the engaged position, in which it is coupled with the pin by friction or through a mechanical coupling, and from which it is moved to the disengaged position by the action of the direct actuation means of the engagement means.

According to an embodiment variant, the mentioned direct actuation means of the engagement means are formed, for each peripheral member, by a respective cam portion arranged in a washer solidly joined to the second part, intended to be fixed to the frame of the vehicle.

According to another feature of the invention, the retaining device is provided with check means for the door and for the indirect actuation of the engagement means, which are introduced in a second cavity arranged transversely to the first cavity, which houses the pin and the enveloping sleeve, and connected to it, acting on the mentioned enveloping sleeve.

According to another feature of the invention, the check means for the door and for the indirect actuation of the engagement means are formed by a considerably horizontally arranged pushing rod introduced in the second cavity of the retaining device, which is subjected to the action of second elastic means pushing it against the enveloping sleeve and is provided with a planar pushing surface, while the outer face of the enveloping sleeve is provided with a planar bevel edge suitable for receiving the support of the pushing surface of the pushing rod during any relative rest position between both parts of the hinge, i.e. during any rest position of the door.

According to a particularly interesting variant of the invention, the rotation of the enveloping sleeve about its axis from the rest position to the position in which it is disconnected from the pin is equal to or less than half the angle separating the two radii passing through the ends of the bevel edge in a cross-section of the enveloping sleeve, whereby if the enveloping sleeve is rotated and no external force is exerted on it, it will return to its original position, the rest position of the hinge, aided by the pushing rod of the check means.

Advantageously, the retaining device is applicable to any hinged connection of two components pivotably connected through an axis of rotation, such as the two hinge leaves of a hinge assembly.

The device could thus be independent, directly integral with the second part of the hinge by welding or indirectly integral upon being fixed to a strut of the frame of the vehicle, or could be integrated in the parts forming a hinge assembly such that the essentially cylindrical first cavity housing the enveloping sleeve, the engagement means and the pin, and, where appropriate, the second cavity, inside which the check means are introduced, can be arranged in the second part of the hinge, forming an integrated part thereof.

BRIEF DESCRIPTION OF THE DRAWINGS

The attached drawings show, by way of a non-limiting example, a hinge for vehicle doors according to the invention. Specifically.

DETAILED DESCRIPTION

Figure 1:
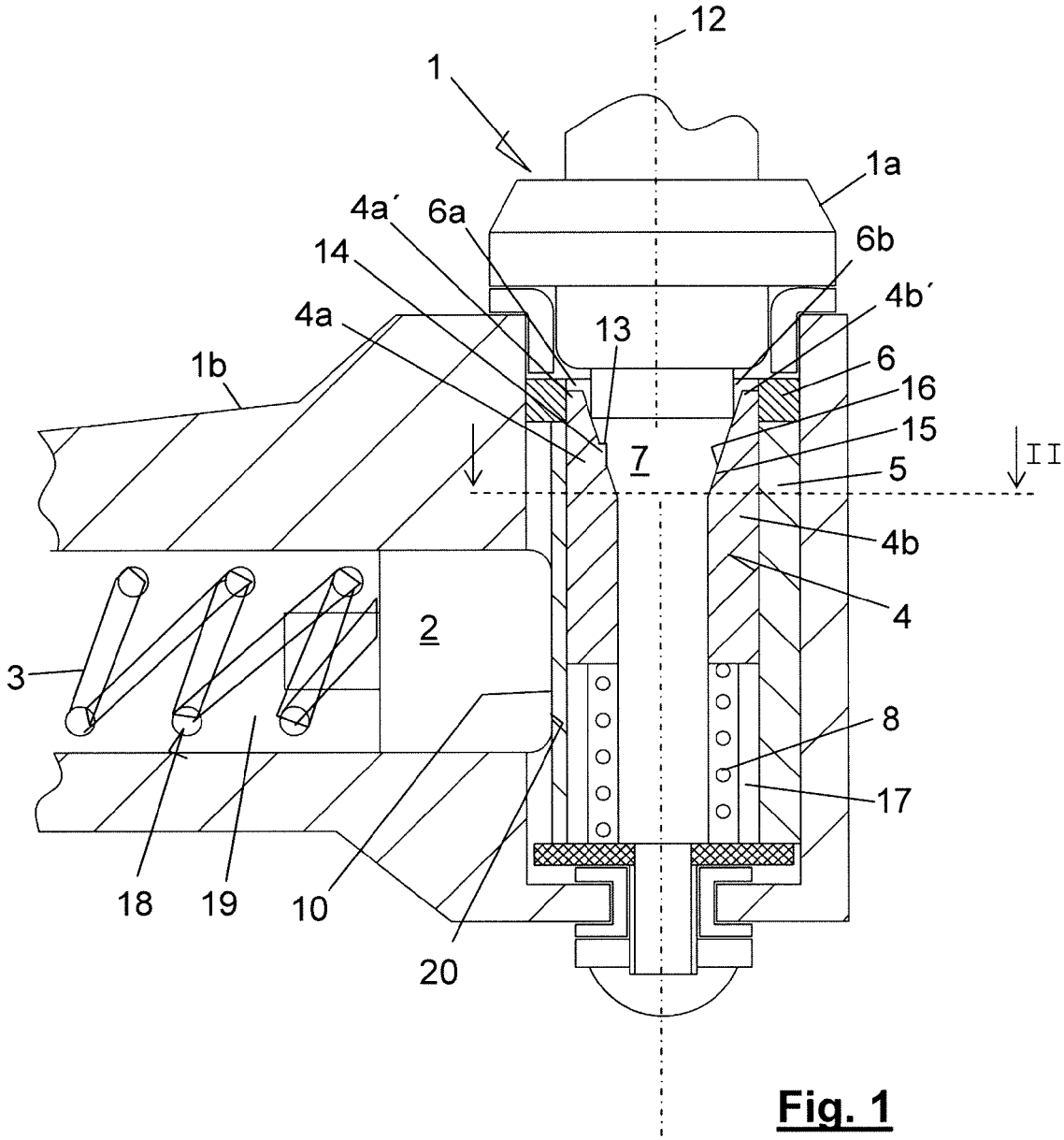
FIG. 1 is an elevational and sectioned view of the hinge according to the invention.

FIGS. 1 and 4 show a retaining device for retaining infinite angular positions between two components pivotably connected through an axis of rotation.

In particular, in the example of FIGS. 1 and 4, the two aforementioned components are formed by a first part 1*a* and a second part 1*b* of a hinge 1 of an automotive vehicle, the components of the retaining device being integrated in the body of the second part 1*b* and the first part 1*a* being integral with the axis of rotation about which both parts rotate, in this case the pin 7 of the hinge 1.

The two complementary parts 1*a* and 1*b* are joined to one another in a known manner by means of the pin 7 of the hinge, essentially vertical in the operative position of the hinge 1, which is integral with first part 1*a* of the hinge 1 as has been stated above. In the mentioned operative position, the first part 1*a* of the hinge is firmly fixed to a vehicle door whereas the second part 1*b* of the hinge is firmly fixed to the chassis of the vehicle. The second part 1*b* is provided with an essentially cylindrical and vertical first cavity 17 in which the pin 7 and an enveloping sleeve 5 are housed, engagement means 4 being arranged between the pin 7 and the enveloping sleeve 5.

Figure 2:
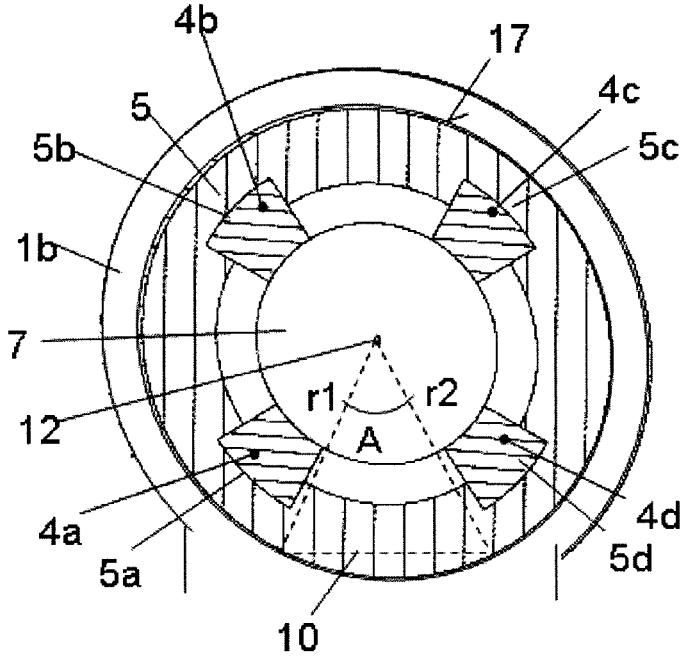
FIG. 2 is a section according to II of the second part and of the enveloping sleeve of the hinge of FIG. 1.

These engagement means 4 are formed by four peripheral members 4*a*, 4*b*, 4*c* and 4*d* arranged contiguous to the pin 7 and assembled in a movable manner through the inside of grooves 5*a*, 5*b*, 5*c* and 5*d*, respectively, made on the inner face of the enveloping sleeve 5 (see FIG. 2).

The peripheral members 4*a*, 4*b*, 4*c* and 4*d* and the grooves 5*a*, 5*b*, 5*c* and 5*d* are regularly distributed, spaced from one another, in the inner contour of the enveloping sleeve 5, and the former are permanently subjected to the action of first elastic means 8, shown in the form of a coil spring, pushing them against a washer 6 arranged at the upper end of the enveloping sleeve 5, coaxial with the latter, integrally joined to the second part 1*b* of the hinge 1.

Figure 3A:
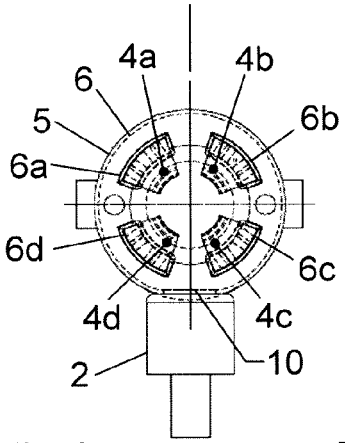
FIGS. 3*a*, 3*b* and 3*c* are respective schematic plan views of the hinge according to three different positions, the first of them being the rest position and the next two being the position of commencing a relative rotational movement between the first and second part forming the hinge, and the engaged position, respectively, in which the direct actuation means of the engagement means, the enveloping sleeve and the mentioned engagement means can be simultaneously observed.

In the position shown in FIG. 3*a*, corresponding to a rest or locking position, the upper ends 15 of the peripheral members 4*a*, 4*b*, 4*c* and 4*d* (see FIG. 1), configured as a wedge, are supported under pressure against a surface 16, with a slope complementary to that of the peripheral members 4*a*, 4*b*, 4*c* and 4*d*, with which the pin 7 is provided, therefore the rotation of the pin 7 would cause the pulling, by friction, of the enveloping sleeve 5, which would rotate simultaneously with the mentioned pin 7. In other words, the pin 7 and the enveloping sleeve 5 are connected and the peripheral members 4*a*, 4*b*, 4*c* and 4*d* occupy an engaged position.

Figure 4A:
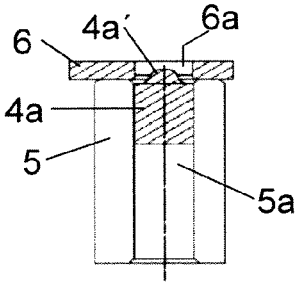
FIGS. 4*a*, 4*b* and 4*c* are respective schematic elevational views of a part of the hinge shown in FIGS. 3*a*, 3*b* and 3*c*, respectively, sectioned according to a vertical plane.

Alternatively, to cause the coupling between the pin 7 and the peripheral members 4*a*, 4*b*, 4*c* and 4*d* in the situation shown in FIG. 1 or in FIGS. 3*a* and 4*a*, the peripheral members 4*a*, 4*b*, 4*c* and 4*d* can be provided with at least one projection 14 intended to be fitted in a recess 13 provided for that purpose in the surface 16 of the pin 7. As regards the washer 6, it is provided with a series of cam portions 6*a*, 6*b*, 6*c* and 6*d* acting on the peripheral members 4*a*, 4*b*, 4*c* and 4*d* when a rotation of the pin 7 occurs.

Indeed, if a rotational movement of the vehicle door is commenced, it will be transmitted through the first part 1*a* of the hinge 1 to pin 7 and due to the effect of the engagement means 4 to the enveloping sleeve 5. When the enveloping sleeve 5 rotates, the peripheral members 4*a*, 4*b*, 4*c* and 4*d* will be moved downwards by the cam portions 6*a*, 6*b*, 6*c* and 6*d* of the washer 6, which acts as actuation means of the engagement means 4.

Figure 3B:
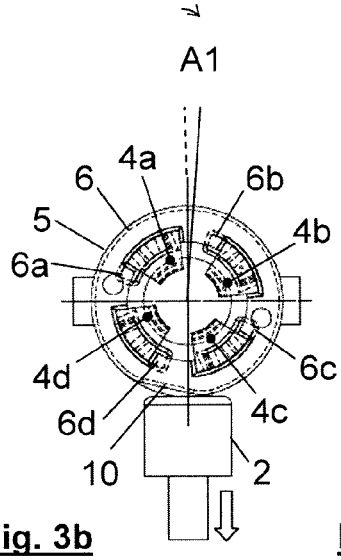

This situation has been shown in FIG. 3*b*, in which it is observed that the enveloping sleeve 5 has rotated an angle A1 in relation to the situation it occupied in FIG. 3*a*. FIG. 4*b* shows how the profile of the cam portion 6*a* makes contact with the upper end 4*a*' of the peripheral member 4*a*, which would cause its movement towards a disengaged position, shown in FIGS. 3*c* and 4*c*, if the rotation of the pin 7 continues.

Figure 3C:
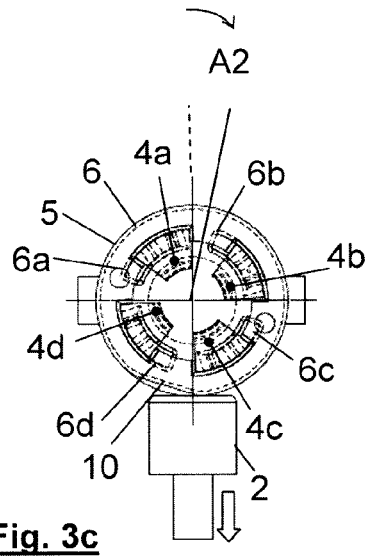
Figure 4B:
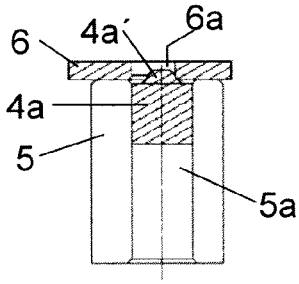
Figure 4C:
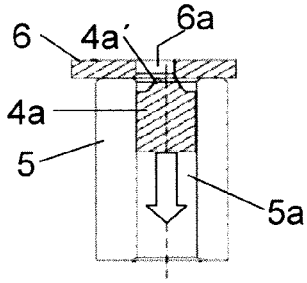
Figure 5:
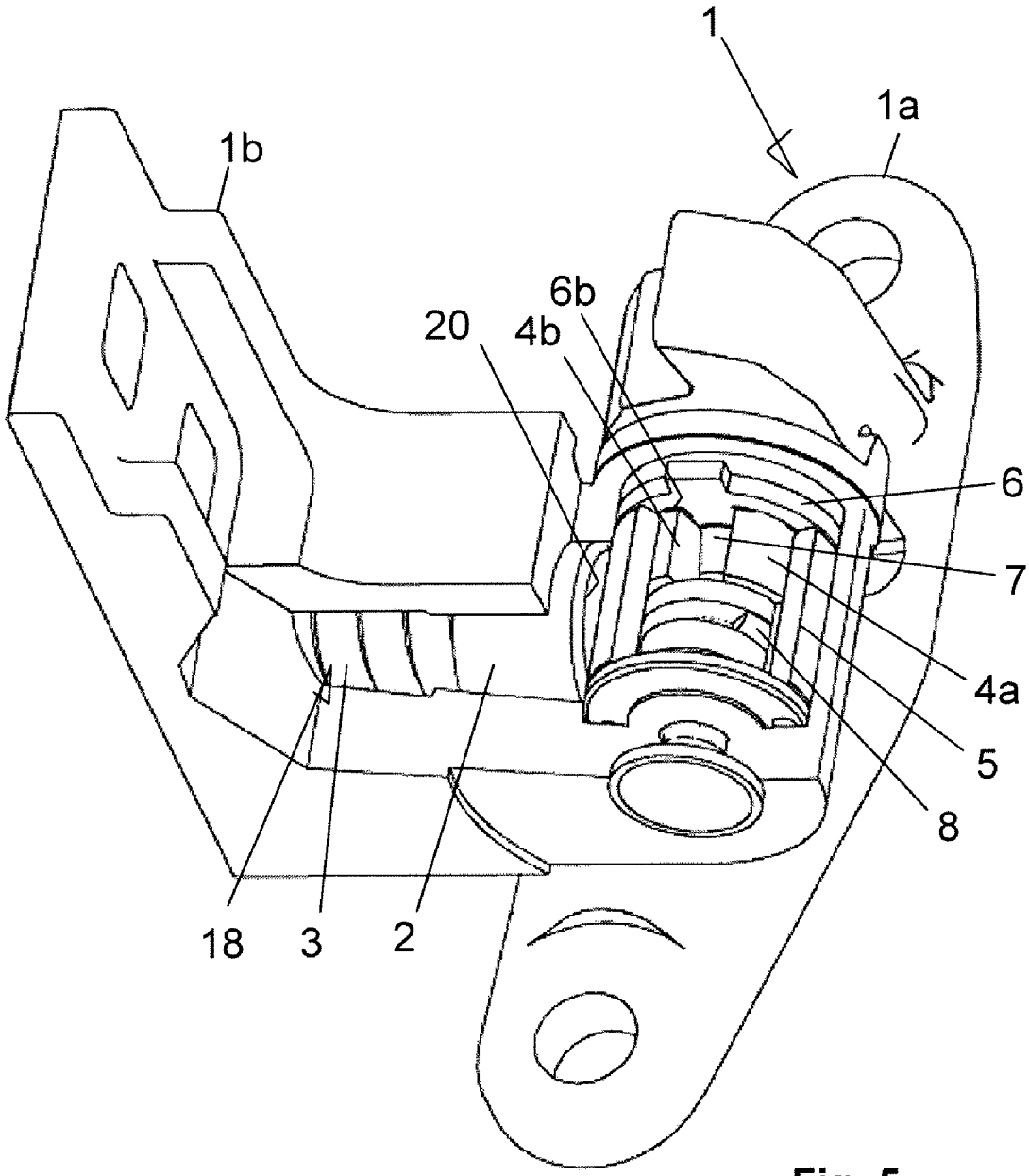
FIG. 5 is a perspective, partially sectioned view of the hinge of FIG. 1.

In FIGS. 3*c* and 4*c*, the enveloping sleeve 5 has rotated a greater angle A2 in relation to the situation it occupied in FIG. 3*a* as a result of continuing the rotation of the vehicle door, and it is observed that the peripheral member 4*a* has been moved in the direction indicated by the arrow of FIG. 4*c*, the first elastic means 8, not shown in this FIG. 4*c*, being compressed.

When this occurs, the automatic disengagement and the disconnection between the pin 7 and the enveloping sleeve 5 occurs when the connection between the projection 14 of the peripheral members 4*a*, 4*b*, 4*c* and 4*d* and the recess 13 of the mentioned pin 7 is disabled or the contact surfaces 15 and 16 of said peripheral members 4*a*, 4*b*, 4*c* and 4*d* and the pin 7 are separated, respectively. As a result, the pin 7 can rotate freely without pulling the enveloping sleeve 5 and therefore the vehicle door can rotate without a significant check.

For the purpose of increasing the retention of the vehicle door in the desired rest position, the hinge further comprises check means 18 introduced in a second cavity 19 arranged transversely to the first cavity 17 and connected to it, acting on the enveloping sleeve 5, all of this as shown in FIGS. 1, 3*a*, 3*b*, 3*c* and 4.

These check means 18 are formed by a considerably horizontally arranged pushing rod 2 introduced in the second cavity 19 of the second part 1*b*, and which is subjected to the action of second elastic means 3 pushing it against the enveloping sleeve 5 such that to commence a rotational movement of the door it is necessary to overcome the force exerted by the pushing rod 2 on the enveloping sleeve 5.

Advantageously, the pushing rod is provided with a planar pushing surface 20 and the outer face of the enveloping sleeve 5 is provided with an also planar bevel edge 10 suitable for receiving the support of the pushing surface of the pushing rod 2 during any relative rest position between both parts of the hinge, i.e. during any rest position of the door.

As observed in FIG. 3*c*, the bevel edge 10 is configured such that the rotation angle A2 of the enveloping sleeve 5 about its axis 12 from the rest position to the position in which it is disconnected from the pin 7 is equal to or less than half the angle A3 separating the two radii r1 and r2 passing through the ends of the bevel edge 10 (see FIG. 2), such that if no force is exerted on the enveloping sleeve 5 from the outside, for example when the door is released and its rotational movement is stopped, the pushing force imparted by the second elastic means 3 to the pushing rod 2 causes the latter to again place the enveloping sleeve 5 in its initial position, rotating it until reaching the stable or rest position shown in FIG. 3*a*, in which the planar pushing surface 20 of the pushing rod is supported against the planar bevel edge 10 of the enveloping sleeve 5.

The rotation of the enveloping sleeve 5 in turn causes the engagement means 4 to be automatically arranged in the engaged position shown in FIGS. 1 and 3*a* due to the effect of the first elastic means 8. For this reason, it can be considered that the check means 18 are also indirect actuation means of the engagement means 4.

Although the retaining device has been shown integrated in one of the parts of the hinge, it is also provided that the retaining device is assembled separately, such that the enveloping sleeve 5 is tightly housed inside a cavity of the outer casing of the device, which in turn would be useful as a support of the check means 18. In this case, for its application to any one hinge, it is only necessary to fix said casing to a first hinge component, for example to the second part 1*b* of a hinge similar to that of FIG. 1, or to a fixed part of the vehicle, and to firmly join the second hinge component, for example the first part 1*a* of a hinge similar to that shown in FIG. 1, to one of the free ends of the pin 7 partially housed inside the enveloping sleeve 5.

It is furthermore stated that the hinge 1 provided with the retaining device according to the invention, integrated or not in one of the parts of the hinge, is detachable, the two parts of the hinge being able to be separated without having to disassemble or uncouple the components of the retaining device.

What is claimed is:

1. A hinge for vehicle doors, comprising:

a first complementary part configured to be fixed to a vehicle door and including an essentially vertical pin;

a second complementary part configured to be fixed to a frame of the vehicle and including an essentially cylindrical and vertical first cavity that houses at least a portion of the vertical pin such that opening or closing of the vehicle door causes relative rotation between the first and second complementary parts when respectively fixed to the vehicle door and the frame of the vehicle; and a retaining device configured to retain infinite angular positions between the first and second complementary parts, the retaining device comprising:

a sleeve disposed in the first cavity and surrounding at least a portion of the pin;

an engagement member arranged between the pin and the sleeve and comprising at least one peripheral member contiguous to the pin, the at least one peripheral member slidably engaging at least one corresponding groove in an inner face of the sleeve such that the at least one peripheral member is movable relative to the pin along a longitudinal axis of the pin between an engaged position and a disengaged position, the engagement member being configured to couple the sleeve to the pin in any angular rest position of the hinge, the engagement member being further configured to automatically decouple the sleeve from the pin during relative rotation between the first and second complementary parts and to automatically couple the sleeve to the pin in response to interruption of the relative rotation between the first and second complementary parts;

a biasing member configured to urge the at least one peripheral member into the engaged position in which the at least one peripheral member is coupled to the pin by friction or through a mechanical coupling; and a direct actuation member arranged at one end of the sleeve and configured to engage the engagement member in response to relative rotation between the first and second complementary parts of the hinge, wherein rotation of the direct actuation member relative to the pin causes the at least one peripheral member to move to the disengaged position.

2. The hinge according to claim 1 wherein the direct actuation member comprises a washer configured to rotate with the second complementary part of the hinge about the pin, the washer comprising at least one cam portion configured to engage the at least one peripheral member to cause longitudinal movement between the engaged and disengaged positions.

3. The hinge according to claim 1, wherein the retaining device further comprises a check member disposed in a second cavity arranged transversely to and connected to the first cavity, the check member being configured to indirectly actuate the engagement member by acting on the sleeve.

4. The hinge according to claim 3, wherein the check member comprises:

a substantially horizontally-arranged pushing rod having a substantially planar pushing surface configured to engage a flattened portion of an outer surface of the sleeve; and a biasing member that urges the pushing surface of the pushing rod into contact with the flattened portion of the outer surface of the sleeve in any angular rest position of the hinge.

5. The hinge according to claim 3, wherein the second cavity is disposed in the second complementary part of the hinge.

6. A hinge for vehicle doors comprising:

a first complementary part configured to be fixed to a vehicle door and including an essentially vertical pin;

a second complementary part configured to be fixed to a frame of the vehicle and including an essentially cylindrical and vertical first cavity that houses at least a portion of the vertical pin such that opening or closing of the vehicle door causes relative rotation between the first and second complementary parts when respectively fixed to the vehicle door and the frame of the vehicle; and a retaining device configured to retain infinite angular positions between the first and second complementary parts, the retaining device comprising:

a sleeve disposed in the first cavity and surrounding at least a portion of the pin;

an engagement member arranged between the pin and the sleeve, the engagement member being configured to couple the sleeve to the pin in any angular rest position of the hinge, the engagement member being further configured to automatically decouple the sleeve from the pin during relative rotation between the first and second complementary parts and to automatically couple the sleeve to the pin in response to interruption of the relative rotation between the first and second complementary parts;

a check member disposed in a second cavity arranged transversely to and connected to the first cavity, the check member being configured to indirectly actuate the engagement member by acting on the sleeve, the check member comprising: a substantially horizontally-arranged pushing rod having a substantially planar pushing surface configured to engage a flattened portion of an outer surface of the sleeve; and a biasing member that urges the pushing surface of the pushing rod into contact with the flattened portion of the outer surface of the sleeve in any angular rest position of the hinge, wherein an angle of rotation of the sleeve about a longitudinal axis of the pin from an angular rest position to a position in which the sleeve is disengaged from the pin is equal to or less than half an angle subtended by ends of the flattened portion of the outer surface of the sleeve, where the subtended angle lies in a plane perpendicular to the longitudinal axis and the subtended angle's vertex coincides with the longitudinal axis; and a direct actuation member arranged at one end of the sleeve and configured to engage the engagement member in response to relative rotation between the first and second complementary parts of the hinge.

* * * * *